US009895035B2

(12) United States Patent
Kang et al.

(10) Patent No.: US 9,895,035 B2
(45) Date of Patent: Feb. 20, 2018

(54) TOILET SEAT ASSEMBLY

(71) Applicant: COWAY CO., LTD, Chungcheongnam-do (KR)

(72) Inventors: Hee-Ju Kang, Seoul (KR); Sung-Worl Jin, Seoul (KR); Young-Pyo Kim, Seoul (KR); Da-Woon Jung, Seoul (KR)

(73) Assignee: COWAY CO., LTD, Chungeheongnam (KR)

( * ) Notice: Subject to any disclaimer, the term of this patent is extended or adjusted under 35 U.S.C. 154(b) by 15 days.

(21) Appl. No.: 15/037,113

(22) PCT Filed: Oct. 7, 2014

(86) PCT No.: PCT/KR2014/009431
§ 371 (c)(1),
(2) Date: May 17, 2016

(87) PCT Pub. No.: WO2015/076494
PCT Pub. Date: May 28, 2015

(65) Prior Publication Data

US 2016/0296085 A1 Oct. 13, 2016

(30) Foreign Application Priority Data

Nov. 25, 2013 (KR) ..... 10-2013-0143520

(51) Int. Cl.
*A47K 3/022* (2006.01)
*A47K 13/30* (2006.01)
(Continued)

(52) U.S. Cl.
CPC ..... *A47K 13/305* (2013.01); *A47K 13/12* (2013.01); *E03D 9/08* (2013.01)

(58) Field of Classification Search
CPC ..... A47K 13/305; A47K 13/12
(Continued)

(56) References Cited

U.S. PATENT DOCUMENTS

2009/0025131 A1* 1/2009 Yamamoto ..... A47K 13/305 4/420
2013/0133131 A1* 5/2013 Peng ..... A47K 13/24 4/444
(Continued)

FOREIGN PATENT DOCUMENTS

JP 2001-8858 1/2001
KR 10-2004-0080785 9/2004
(Continued)

OTHER PUBLICATIONS

International Search Report PCT/KR2014/009431, dated Jan. 7, 2015 (4 pages).

*Primary Examiner* — Huyen Le
(74) *Attorney, Agent, or Firm* — Dority & Manning, P.A.

(57) ABSTRACT

Provided is a toilet seat assembly comprising: a bidet housing for defining the appearance of a bidet; a hinge member which is fixed to the inner side of the bidet housing and is provided with a shaft, wherein the hinge member is provided with a circular ring-shaped coupling groove formed along the outer circumference of the shaft; and a toilet seat connected to the shaft so as to allow rotation thereon, wherein the bidet housing is provided with a coupling protrusion protruding to the inner side so as to be inserted into the coupling groove. Thus, it is possible to prevent moisture from permeating into the inside of the bidet housing, and to facilitate wiring of wires for supplying electricity to a heating device provided in the toilet seat.

10 Claims, 3 Drawing Sheets

(51) Int. Cl.
*A47K 13/12* (2006.01)
*E03D 9/08* (2006.01)

(58) Field of Classification Search
USPC ..... 4/444
See application file for complete search history.

(56) References Cited

U.S. PATENT DOCUMENTS

2013/0152296 A1* 6/2013 Bickerstaffe ..... E03D 9/08
4/444
2015/0152296 A1* 6/2015 Rosa ..... C09J 11/06
524/108

FOREIGN PATENT DOCUMENTS

KR 20-0410526 3/2006
KR 10-2009-0107797 10/2009
KR 10-2010-0098218 9/2010

* cited by examiner

[Fig. 1]
100
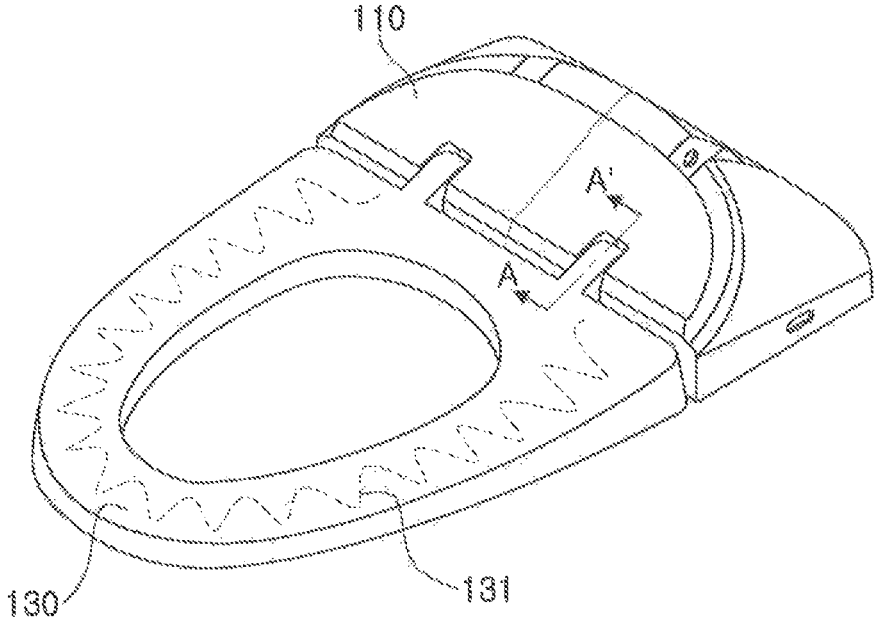

【Fig. 2】
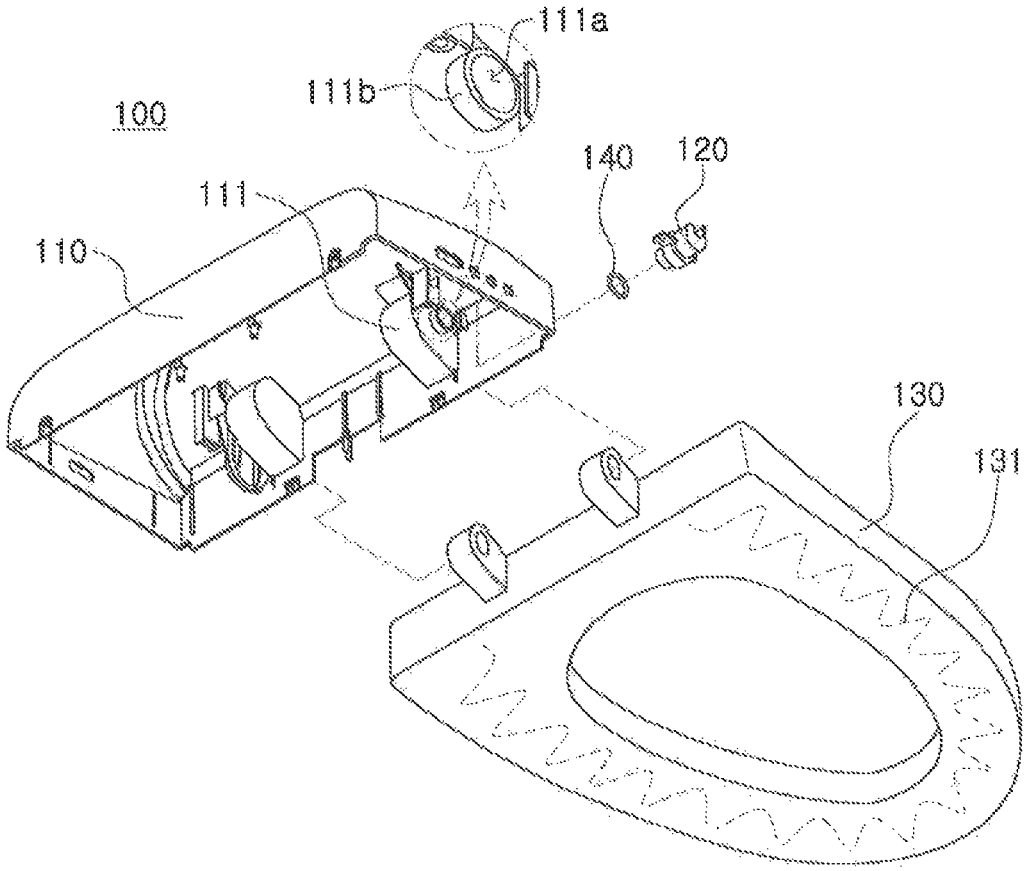

【Fig. 3】
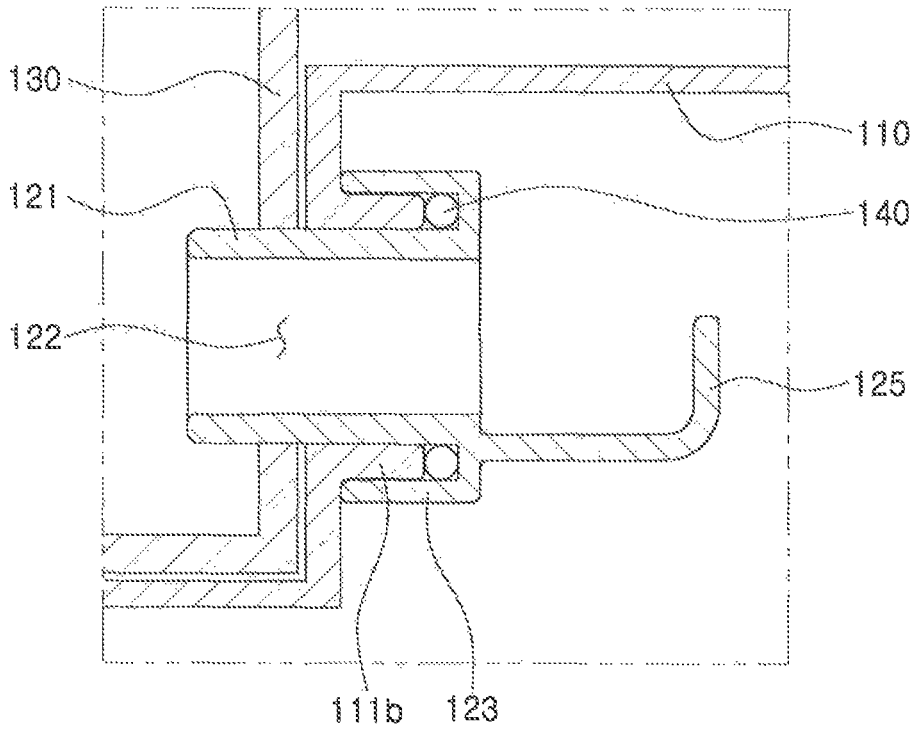
【Fig. 4】
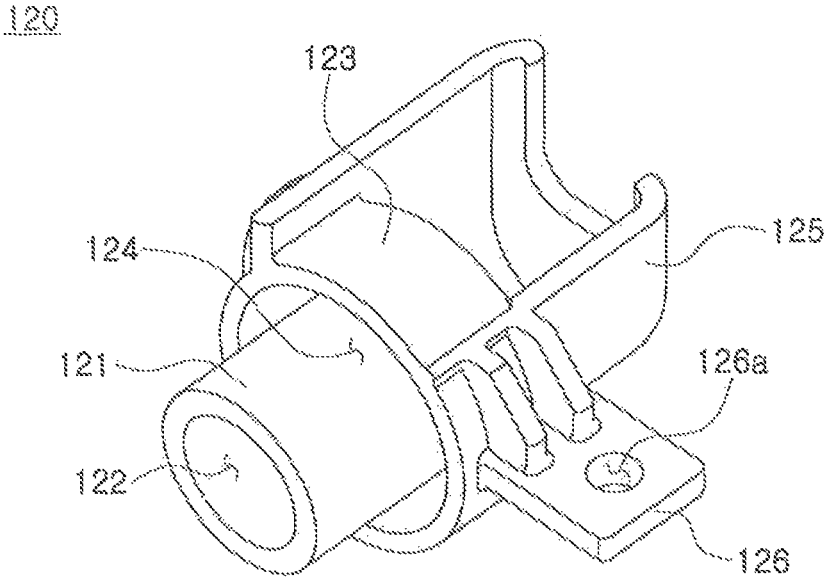

TOILET SEAT ASSEMBLY

TECHNICAL FIELD

The present disclosure relates to a toilet seat assembly and, more particularly, to a toilet seat assembly capable of preventing internal penetration of moisture through a separate hinge member hinge-coupling a bidet housing and a toilet seat.

BACKGROUND ART

A toilet in a restroom has a toilet seat which a user may sit on, and here, such a toilet seat is installed to be attached on top of a toilet.

Recently, toilet seats have continuously been developed through bidet technology for the purpose of making a restroom interior agreeable and practicing hygiene among users.

In general, a bidet is a toilet seat intended for washing and cleaning the genitalia and the anus after a user relieves himself/herself. That is, after a user relieves himself/herself, hot water having an appropriate temperature is dispensed from a central portion of a plumbing fixture, without the necessity for the user to use a hand, to smoothly clean a part intended to be cleaned.

A toilet seat is in direct contact with a user's buttocks when the user relieves himself/herself, causing a problem in that when the user sits on the toilet seat, the user may feel cold. In particular, such a problem may be magnified in the winter season. Thus, recently, in order to solve the problem, a heating device such as a hot wire is provided in the toilet seat to keep the toilet seat warm.

Here, the heating device provided within the toilet seat is generally operated by electricity, requiring wiring for supplying electricity. Preferably, such wiring is not exposed outwardly in terms of safety and aesthetic design.

Meanwhile, various devices operated by electricity are provided within a bidet, which may be easily exposed to moisture in terms of characteristics of an environment of installation of a bidet. Thus, a structure preventing penetration of moisture to an interior of a bidet is essential.

DISCLOSURE

Technical Problem

Therefore, an object of the present invention is to provide a toilet seat assembly which facilitates wiring and prevents penetration of moisture into a bidet

Technical Solution

According to an aspect of the present invention, there is provided a toilet seat assembly including: a bidet housing for defining the appearance of a bidet; a hinge member fixed to an inner side of the bidet housing and having a shaft, the hinge member having an annular coupling groove formed on an outer circumferential surface of the shaft; and a toilet seat rotatably connected to the shaft, wherein the bidet housing has a coupling protrusion protruding to the inner side and inserted into the coupling groove.

In the toilet seat assembly according to the present disclosure, the bidet housing may have a toilet seat connection part provided on an inner side thereof and having a hinge coupling hole formed on one side thereof, and one end of the shaft may protrude to an outer side of the toilet seat connection part through the hinge coupling hole.

In the toilet seat assembly according to the present disclosure, the hinge member may include a housing coupling part extending outwardly in a radial direction from the other end of the shaft and extending toward one end of the shaft in an axial direction, and the coupling groove may be formed by the housing coupling part on an outer circumferential surface of the shaft.

In the toilet seat assembly according to the present disclosure, the coupling protrusion may have a cylindrical shape formed on a circumference of the hinge coupling hole.

The toilet seat assembly according to the present disclosure may further include an annular ring inserted into the coupling groove.

In the toilet seat assembly according to the present disclosure, the ring may be formed of rubber.

In the toilet seat assembly according to the present disclosure, the shaft may have a wire transfer hole provided on an inner side thereof.

In the toilet seat assembly according to the present disclosure, the toilet seat may have a heating device and a wire for supplying electricity to the heating device, and the wire may be connected through the wire transfer hole.

In the toilet seat assembly according to the present disclosure, the hinge member may further include a wire duct extending in an axial direction from the other end of the shaft.

In the toilet seat assembly according to the present disclosure, the hinge member may further include a fixing portion having a bolt hole, and may be fixed to the bidet housing through screw-coupling of the bolt penetrating through the bolt hole.

Advantageous Effects

In the toilet seat assembly according to embodiments of the present disclosure, penetration of moisture to an interior of a bidet may be prevented, and wiring related to a heating device within the toilet seat may be facilitated.

DESCRIPTION OF DRAWINGS

FIG. 1 is a perspective view of a toilet seat assembly according to an exemplary embodiment in the present disclosure;

FIG. 2 is an exploded perspective view of a toilet seat assembly according to an exemplary embodiment in the present disclosure;

FIG. 3 is a partial cross-sectional view taken along line A-A' of FIG. 1; and FIG. 4 is a perspective view of a hinge member according to an exemplary embodiment in the present disclosure.

BEST MODE FOR INVENTION

Referring to FIGS. 1 through 3, a toilet seat assembly 100 according to an exemplary embodiment in the present disclosure may include a bidet housing 110, a toilet seat 130 rotatably connected to a shaft, and a hinge member 120 fixed to the bidet housing 110 and rotatably connecting the toilet seat 130 to the bidet housing 110.

The bidet housing 110 defines an appearance of the bidet, and within the bidet housing 110, a reservoir (not shown) storing water upon receiving the water from a water source, a nozzle assembly (not shown) dispensing water stored in the reservoir to the anus or genitalia of a user, and various driving devices for operating the nozzle assembly may be provided.

Also, the bidet housing 110 may have at least one toilet seat connection part 111 provided on an inner side thereof. A hinge coupling hole 111*a* may be formed on one side of the toilet seat connecting part 111. In addition, the bidet housing 110 may have a cylindrical coupling protrusion 111*b* protruding inwardly along a circumference of the hinge coupling hole 111*a*. When the hinge member 120 is coupled to the bidet housing 110, the coupling protrusion 111*b* may be inserted into a coupling groove 124 (to be described hereinafter).

The toilet seat 130 may be rotatably connected to the bidet housing 110, and here, the toilet seat 130 may be connected to the bidet housing 110 through a hinge member 120.

Also, the toilet seat 130 may have a heating device 131 therein. When a user relieves himself/herself, the toilet seat 130 is in direct contact with the user's buttocks, and thus, the heating device 131 may operate to adjust a temperature of a surface to obtain a heat reserving effect. Here, the heating device 131 may be a hot wire heater. However, the present disclosure is not limited thereto, and any other heating device known to a person skilled in the art may also be used as long as it can increase a temperature of a surface of the toilet seat 130 by supplying electricity. The heating device 131 may be operated by electricity, and the toilet seat 130 may further include a wire (not shown) for supplying electricity to the heating device 131.

Referring to FIGS. 1 through 4, the hinge member 120 may be fixed to an inner side of the bidet housing 110, and may have a shaft 121 having one end protruding to an outside of the toilet seal connection part 111 through the hinge coupling hole 111*a*.

A wire transfer hole 122 may be provided on an inner side of the shaft 121, and the wire (not shown) may pass through the wire transfer hole 122. In this manner, since the wire (not shown) passes through the wire transfer hole 122, wiring may be facilitated without exposing the wire (not shown).

Also, the hinge member 120 may have a housing coupling part 123 extending outwardly in a radial direction from the other end of the shaft 121 and extending toward one end of the shaft 121 in an axial direction. Accordingly, an annular coupling groove 124 may be formed on an outer circumferential surface of the shaft 121. In other words, the coupling groove 124 may be formed between the outer circumferential surface of the shaft 121 and the housing coupling portion 123. Accordingly, when the hinge member 120 is fixed to the bidet housing 110, the coupling protrusion 111*b* may be inserted into the coupling groove 124. In this manner, as the coupling protrusion 111*b* is inserted into the coupling groove 124, a sealing structure may be formed to prevent penetration of moisture to an interior of the bidet housing 110.

Meanwhile, the hinge member 120 may further include a wire duct 125 extending in an axial direction from the other end of the shaft 121. The wire duct 125 may accommodate a portion of the wire (not shown) passing through the wire transfer hole 122, facilitating wiring.

Conversely, the hinge member 120 may further include a fixing portion 126 in which a bolt hole 126*a* is formed, and may be fixed to the bidet housing 110 through screw coupling of a bolt (not shown) penetrating through the bolt hole 126*a*.

The toilet seat assembly 100 according to an exemplary embodiment in the present disclosure may further include an annular ring 140 inserted into the coupling groove 124. The ring 140 may be formed of rubber. That is, the ring 140 may be positioned between the housing coupling part 123 and the coupling protrusion 111*b*, forming a sealing structure, whereby penetration of moisture to the interior of the bidet housing 110 may be more effectively prevented.

As described above, according to the toilet seat assembly 100 according to an exemplary embodiment in the present disclosure, penetration of moisture to an interior of the bidet housing 110 may be effectively prevented, and wiring of the wire (not shown) supplying electricity to the heating device 131 provided within the toilet seat 130 may be facilitated.

While embodiments have been shown and described above, it will be apparent to those skilled in the art that modifications and variations could be made without departing from the scope of the present disclosure as defined by the appended claims.

The invention claimed is:

1. A toilet seat assembly comprising:

a bidet housing for defining the appearance of a bidet;

a hinge member fixed to an inner side of the bidet housing and having a shaft, the hinge member having an annular coupling groove formed on an outer circumferential surface of the shaft; and a toilet seat rotatable connected to the shaft, wherein the bidet housing has a coupling protrusion protruding to the inner side and inserted into the coupling groove, wherein the toilet seat is rotatably installed in the bidet housing via the hinge member, and wherein the toilet seat rotates about the shaft of the hinge member.

2. The toilet seat assembly of claim 1, wherein the bidet housing has a toilet seat connection part provided on an inner side thereof and having a hinge coupling hole formed on one side thereof, and one end of the shaft protrudes to an outer side of the toilet seat connection part through the hinge coupling hole.

3. The toilet seat assembly of claim 2, wherein the hinge member includes a housing coupling part extending outwardly in a radial direction from the other end of the shaft and extending toward one end of the shaft in an axial direction, and the coupling groove may be formed by the housing coupling part on an outer circumferential surface of the shaft.

4. The toilet seat assembly of claim 3, wherein the coupling protrusion has a cylindrical shape formed on a circumference of the hinge coupling hole.

5. The toilet seat assembly of claim 1, further comprising an annular ring inserted into the coupling groove.

6. The toilet seat assembly of claim 5, wherein the ring is formed of rubber.

7. The toilet seat assembly of claim 1, wherein the shaft has a wire transfer hole provided on an inner side thereof.

8. The toilet seat assembly of claim 7, wherein the toilet seat has a heating device and a wire for supplying electricity to the heating device, and the wire is connected through the wire transfer hole.

9. The toilet seat assembly of claim 1, further comprising a wire duct extending in an axial direction from the other end of the shaft.

10. The toilet seat assembly of claim 1, wherein the hinge member further includes a fixing portion having a bolt hole, and is fixed to the bidet housing through screw-coupling of the bolt penetrating through the bolt hole.

* * * * *